US007465694B2

(12) United States Patent
Date et al.

(10) Patent No.: US 7,465,694 B2
(45) Date of Patent: Dec. 16, 2008

(54) THERMALLY SENSITIVE RECORDING MEDIUM

(75) Inventors: Takashi Date, Tokyo (JP); Mizuho Shimoyama, Tokyo (JP); Koichi Yanai, Tokyo (JP); Kenji Hirai, Tokyo (JP)

(73) Assignee: Nippon Paper Industries Co., Ltd., Tokyo (JP)

( * ) Notice: Subject to any disclaimer, the term of this patent is extended or adjusted under 35 U.S.C. 154(b) by 0 days.

(21) Appl. No.: 11/663,229

(22) PCT Filed: Sep. 30, 2005

(86) PCT No.: PCT/JP2005/018592

§ 371 (c)(1),
(2), (4) Date: Mar. 19, 2007

(87) PCT Pub. No.: WO2006/036034

PCT Pub. Date: Jun. 4, 2006

(65) Prior Publication Data

US 2007/0265163 A1 Nov. 15, 2007

(30) Foreign Application Priority Data

Sep. 30, 2004 (JP) ..... 2004-288398

(51) Int. Cl.
*B41M 5/41* (2006.01)

(52) U.S. Cl. ..... 503/200; 503/226

(58) Field of Classification Search ..... None
See application file for complete search history.

(56) References Cited

FOREIGN PATENT DOCUMENTS

| | | | |
|---|---|---|---|
| JP | 05-096849 | * | 4/1993 |
| JP | 08-091820 | * | 4/1996 |
| JP | 2002-274837 | * | 9/2002 |

* cited by examiner

*Primary Examiner*—Bruce H Hess
(74) *Attorney, Agent, or Firm*—Flynn, Thiel, Boutell & Tanis, P.C.

(57) ABSTRACT

A thermally sensitive recording medium has at least one layer on a substrate which is a thermally sensitive recording layer that contains a colorless or pale colored electron-donating leuco dye and an electron-accepting color-developing agent. At least one layer on the substrate contains a hydrated silicic acid compound which is treated by wet grinding treatment in a deposition process of the hydrated silicic acid compound. A thermally sensitive recording medium of high brightness, which is superior in color-developing sensitivity and coating layer strength and, further, has excellent head abrasion resistance, less debris adhering and sticking resistance is obtained.

6 Claims, No Drawings

THERMALLY SENSITIVE RECORDING MEDIUM

FIELD OF THE INVENTION

The present invention relates to a thermally sensitive recording medium which utilizes a color-developing reaction of a basic colorless dye with an organic color-developing agent.

BACKGROUND OF THE INVENTION

A thermally sensitive recording medium having a thermally sensitive recording layer (called a thermally sensitive color-developing layer or a thermally sensitive layer) containing a colorless or pale colored dye precursor and a color-developing agent which develops color by a thermal reaction with the colorless or pale colored dye precursor as main components was disclosed in Japanese Patent S45-14039 B publication and is widely utilized. A thermal printer in which a thermal head is built in is used to record images on the thermally sensitive recording medium, and when compared with the conventional recording method, this thermally sensitive recording method has advantages that it is noiseless at the recording process, developing and fixing processes are not necessary, it is maintenance-free, an apparatus is relatively cheap and compact, and an obtained color is very clear. Therefore, it is widely applied as recording papers for industrial information such as a facsimile, a terminal printer of a computer, a recorder for a measuring instrument or a label. Recently, the uses are becoming diversified and, along with the diversification of uses, recording instruments are becoming compact and high speed. Accordingly, a thermally sensitive recording medium on which a clear developed image can be obtained by a small amount of thermal energy is desired.

For the purpose of satisfying these requirements, a method of enhancing the color-developing sensitivity by adding a thermal fusible substance in a thermally sensitive recording layer (Patent Document 1), a method of enhancing the color-developing sensitivity by using a novel color-developing agent having a high color-developing ability and a method of combining a specific color-developing agent and specific sensitizer (Patent Document 2, Patent Document 3 and Patent document 4) are disclosed. However, problems such as the deterioration of the heat-resistance of ground color, powdering by time lapse, deterioration of re-printing ability, deterioration of debris-adhering resistance or deterioration of sticking resistance. In particular, the deterioration of the debris-adhering resistance and deterioration of sticking resistance are becoming big problems. The deterioration of the debris-adhering resistance and deterioration of sticking resistance are caused by the fusing and adhering of components contained in a thermally sensitive color-developing layer by heat from a thermal head. Aiming to solve said problems, a method of containing fine particles of an amorphous silica having a specific particle size distribution, specific BET surface area and bulk density (Patent Document 5) is disclosed, however, because the surface activity of the silica promotes a reaction between a leuco dye and a color-developing agent, the problem of a ground color developing (background coloring) arises. Further, in the case when ordinary silica is used, since the surface strength (coating layer strength) of a thermally sensitive recording medium deteriorates, not only a problem of staining of a blanket arises at an offset printing, but also the head abrasion-resistance is deteriorated.

Patent Document 1 JP S56-169087 A publication
Patent Document 2 JP S56-144193 A publication Patent Document 3 JP S60-82382 A publication
Patent Document 4 JP S57-201691 A publication
Patent Document 5 JP S58-87094 A publication

DISCLOSURE OF THE INVENTION

The object of the present invention is to provide a thermally sensitive recording medium of high brightness, which is superior in color-developing sensitivity and coating layer strength and, further, is excellent in head abrasion resistance, less debris adhering and sticking resistance.

According to the earnest investigation of the inventors, the object of the present invention mentioned above is solved by a thermally sensitive recording medium comprising, single or multi layers, wherein, at least one layer on a substrate is a thermally sensitive recording layer that contains a colorless or pale colored electron donating leuco dye and an electron-accepting color-developing agent and, further, at least one layer on the substrate contains a hydrated silicic acid compound which is treated by a wet grinding treatment in a deposition process of the hydrated silicic acid compound.

DESCRIPTION OF THE PREFERRED EMBODIMENT

The thermally sensitive recording medium of the present invention can contain a hydrated silicic acid compound, which is treated by wet grinding treatment in a hydrated silicic acid compound deposition process, in a thermally sensitive color-developing layer, a precoating layer formed between a substrate and the thermally sensitive color-developing layer, a protecting layer formed on the thermally sensitive color-developing layer or an intermediate layer formed between the thermally sensitive color-developing layer and the protecting layer. The thermally sensitive recording medium of the present invention contains said hydrated silicic acid compound in at least one of these layers, especially, excellent effect can be accomplished by containing it in the thermally sensitive color-developing layer. Further, the thermally sensitive color-developing layer, precoating layer, protecting layer or intermediate layer can be formed by singularly or in plural.

Since the hydrated silicic acid compound (silica) is a bulky pigment possessing specific features such as a high oil-absorbing capacity and excellent adiabatic ability, a technique for containing the hydrated silicic acid compound whose particle size, oil-absorption amount and specific surface area are regulated in a thermally sensitive color-developing layer, an undercoating layer or a protecting layer is disclosed. However, since the particle size distribution of a conventional hydrated silicic acid compound is broad, for example, although the color-developing sensitivity is good, new problems of the coating layer strength and head abrasion resistance deteriorating arise.

When a layer containing a hydrated silicic acid compound A whose particle size distribution is broad with a layer containing a hydrated silicic acid compound B whose particle size distribution is sharp are compared, wherein the average particle size of silicate A and silicate B are equal, the strength of the coating layer containing the hydrated silicic acid compound A is weaker than the strength of the coating layer containing the hydrated silicic acid compound B, if the amount of a binder are the same. The reason why is that the containing ratio of the hydrated silicic acid compound of the small particle size (specific surface area is large), which needs a binder, in the hydrated silicic acid compound A is large.

Therefore, with the same amount of binder, the strength of the layer containing the hydrated silicic acid compound A becomes weak. Accordingly, problems, for example, the adhesion of a stain to a blanket easily arises during an offset printing process. It is possible to improve the strength of the coating layer to the same level by increasing the amount of binder in the coating layer containing the hydrated silicic acid compound A, however, in this case, since the containing ratio of the hydrated silicic acid compound in the coating layer becomes low, the problem of the deterioration of the color-developing sensitivity arises. Further, when the hydrated silicic acid compound A and hydrated silicic acid compound B are contained in a thermally sensitive color developing layer or a protecting layer, which contacts with a thermal head, the thermal head abrasion becomes worse when a hydrated silicic acid compound A is contained. The reason why is considered as follows. That is, since many hydrated silicic acid compounds of a larger particle size is contained in hydrated silicic acid compound A, the large hydrated silicic acid compound particles make contact with the thermal head. However, by the reason mentioned below, the desired quality cannot be obtained by use of the conventional hydrated silicic acid compound.

In general, as a method for the preparation of a hydrated silicic acid compound, there are two methods, that is, one is the precipitation method that reacts sodium silicate with sulfuric acid by an alkaline reaction and another one is the gelling method that reacts sodium silicate with sulfuric acid by an acid reaction. In general, in these mentioned preparation methods, sodium silicate is completely neutralized by sulfuric acid and deposited coarse particles of a hydrated silicic acid compound are dried, ground, classified and adjusted to the desired particle size. However, it is very difficult to control the particle size distribution. It is considered that the deposited coarse particles of the hydrated silicic acid compound are re-aggregated by the drying process and form larger hydrated silicic acid compound particles. That is, when large particles and small particles are treated so as to be the same particle size, in the case of grinding large particles, there is a possibility that finely ground particles and coarser ground particles are largely mixed together. In the case when dried hydrated silicic acid compounds are ground by a grinding machine such as a bead mill, hydrated silicic acid compound particles re-aggregate by the heat of abrasion generated between the hydrated silicic acid compound particles and beads, therefore, the particle size distribution of the obtained hydrated silicic acid compound particles becomes broad. Further, it is possible to make the particle size distribution sharper by classifying the obtained ground particles, but it is not sufficient to meet the desired higher quality level.

On the other hand, the hydrated silicic acid compound used in the present invention is ground by wet grinding at the deposition process of the hydrated silicic acid compound, specifically, during the neutralization reaction process of sodium silicate. That is, the prior hydrated silicic acid compound forms coarser particles, is ground in a wet condition so as to form a desired particle size and, therefore, the particle size distribution becomes sharp. It is desirable to carry out said neutralization reaction process and wet grinding process by dividing them several times, and it is possible to carry out the wet grinding process before the neutralization reaction process is over and adjust to the desired particle size. Further, by carrying out wet grinding, it is possible to prevent the generation of abrasion heat between the hydrated silicic acid compound and beads, and a more sharp particle size distribution can be obtained.

In the present invention, by using the hydrated silicic acid compound obtained as above, a thermally sensitive recording medium characterized as having a strong coating layer strength and excellent printing aptitude can be obtained. Further, by using the hydrated silicic acid compound in a layer that contacts with a thermal head, a thermally sensitive recording medium characterized in having an excellent head abrasion resistance too can be obtained.

The particle size distribution of the hydrated silicic acid compound contained in the thermally sensitive recording medium of the present invention is measured by a laser ray method and, in a particle size distribution by volume average particle size, it is desirable that the difference of particle size (D10/D90) between the particle size which contains a 10% integrated volume from the minimum size (D10) and contains a 90% integrated volume from the minimum size (D90) is 9 μm or less, and the difference in particle size (D20/D80) between the particle size which contains a 20% integrated volume from the minimum size (D20) and contains a 80% integrated volume from the minimum size (D80) is 5 μm or less, more desirably D10/D90 is 7 μm or less, and D20/D80 is 4 μm or less.

When D10/D90 is larger than 9 μm, the problems of the deterioration of the head abrasion resistance or deterioration of surface strength arise.

The average particle size of the hydrated silicic acid compound contained in the thermally sensitive recording medium of the present invention is desirably 1-15 μm by a laser ray method, more desirably 1-8 μm, furthermore desirably is 1-4 μm. When the average particle size is less than 1 μm, sufficient surface strength cannot be obtained, and when the average particle size is larger than 15 μm, the head abrasion resistance becomes a problem.

The oil-absorption amount of the hydrated silicic acid compound contained in the thermally sensitive recording medium of the present invention is 100-350 ml/100 g, desirably 130-350 ml/100 g. When the oil-absorption amount is smaller than 100 ml/100 g, it is difficult to absorb a fused color-developing material by the heat of a thermal head and it causes the problem of adhering of debris to the thermal head and, when larger than 350 ml/100 g, the surface strength deteriorates.

Further, in the present invention, the thermally sensitive recording medium that has good head debris resistance and excellent brightness, besides a strong surface strength and head abrasion resistance, can be obtained by using a hydrated silicate as a hydrated silicic acid compound. The reason why the above-mentioned excellent effect is obtained is not clear, but is guessed as follows.

That is, the hydrated silicate obtained by the neutralization of an aqueous solution of sodium silicate with a mineral acid and an aqueous solution of an acidic metallic salt is a complex composed of a hydrated silicic acid compound and a metallic compound, and the amount of the metallic compound is larger than that of a conventional hydrated silicic acid compound obtained by a neutralization reaction of an aqueous solution of sodium silicate with sulfuric acid, and this metallic compound promotes the adsorption of a leuco dye, a color-developing agent or a sensitizer, which are fused by the heat of a thermal head, to the hydrated silicate. Accordingly, a high color-developing sensitivity is displayed. Further, since superfluously fused color-developing material is adsorbed too, debris adhesion to the thermal head is protected.

Furthermore, the activity is weakened compared with a conventional hydrated silicic acid compound because the relative amount of a hydroxide group that the hydrated silicic acid compound has become small by containing a metallic compound. Therefore, not only the deterioration of the brightness at the preparation of a coating is protected, but also the brightness of a coating layer is improved, because the refractive index of aluminum oxide is 1.65, while, that of silica is 1.48-1.49, namely, the refractive index of metallic compound is relatively higher than that of silica.

In the present invention, it is desirable that the hydrated silicate contains 1.0-8.0 weight % of a metallic compound (to $SiO_2$ weight %) by converted value to oxide, more desirably 1.0-6.0 weight %. If the content of the metallic compound is smaller than 1.0 weight %, the effect is not displayed sufficiently. While, if the content of the metallic compound is larger than 8.0 weight %, a sufficient effect cannot be obtained because the crystalline morphology is transferred.

In the thermally sensitive recording medium of the present invention, as the specific example of a metallic compound contained in the hydrated silicate, an oxide of an alkali earth metal such as magnesium oxide, calcium oxide, strontium oxide or barium oxide, titanium oxide, zirconium oxide, nickel oxide, iron oxide or aluminum oxide can be mentioned, however, it is not intended to be restricted to these compounds. Among these compounds, aluminum oxide is most desirable from the view point of brightness and oil-absorption amount.

The thermally sensitive recording medium of the present invention, can contain a hydrated silicic acid compound, which is treated by a wet grinding treatment in a hydrated silicic acid compound deposition process, in at least one layer selected from the group consisting of an undercoating layer formed between a substrate and a thermally sensitive color-developing layer, a protecting layer formed on a thermally sensitive color-developing layer and an intermediate layer formed between a thermally sensitive color-developing layer and a protecting layer for the purpose to improve color-developing sensitivity. In the meanwhile, a thermally sensitive color-developing layer, an undercoating layer, a protecting layer and an intermediate layer can be formed singularly or in multiple.

The hydrated silicic acid compound used in the present invention is disclosed in the JP2002-274837 A publication or JP 2908253 publication, and can be prepared as follows. That is, a mineral acid (sulfuric acid) is added by dividing it several times to an aqueous solution of sodium silicate and treated by wet-grinding treatment in a hydrated silicic acid compound deposition process so as to have the desired average particle size. Further, in the preparation process of the hydrated silicate used in the present invention, it is desirable to carry out a neutralizing reaction by dividing it through several processes, however, if the number of neutralizing processes becomes excessive, the production effect deteriorates. Therefore, it is desirable to divide the neutralizing reaction into 3 processes.

As disclosed in JP 2908253 publication, the hydrated silicic acid compound used in the present invention can be ground in a wet condition by a ball mill, such as a ball mill or rod mill, a medium stirring grinding machine, such as a tower mill, attriter, satory mill, sand grinder or annular mill or a high speed rotating grinding machine such as colloid mill, homo mixer or inline mill, and desirably the grinding condition can be voluntarily adjusted. The particles of deposited silica or silicate are very fine, especially, since the silica deposited in the first process is easy to grind, it can be ground by a dispersing machine or an emulsifying machine besides the above-mentioned grinding machine, it is possible to use these machines by combining.

The hydrated silicate used in the thermally sensitive recording medium of the present invention can be obtained by replacing a part of the mineral acid (sulfuric acid) by an aqueous solution of an acidic metallic salt in the above-mentioned method for the preparation of the hydrated silicic acid compound. As a metal element composing the aqueous solution of the acidic metallic salt, for example, an alkali earth metal element such as magnesium, calcium, strontium or barium or titanium, zirconium, nickel iron or aluminum and as an aqueous solution of an acidic metallic salt, an acidic metallic sulfate can be mentioned, and it is not restricted, however, it is desirable to use aluminum sulfate.

The hydrated silicate used in the thermally sensitive recording medium of the present invention whose content of metallic compound is 0.5-8.0 weight % (to $SiO_2$ weight %, measured by fluorescent X-ray analyzer Oxford ED2000) by converted value to an oxide can be obtained by using an aqueous solution of an acidic metallic salt corresponding to 5-60 weight % to a neutralization equivalent of sodium silicate instead of a mineral acid (sulfuric acid) in at least one process during the adding process of the acid in the above-mentioned method for the preparation of a hydrated silicic acid compound. The oil-absorption amount of the hydrated silicate becomes an almost equal level to that of the hydrated silicic acid compound which is prepared without adding the aqueous solution of the acidic metal, further the advantage that the specific scattering coefficient becomes high can be also accomplished by silication.

In the thermally sensitive recording medium, the content of the hydrated silicate is desirably within the following range for each layer. That is, 10-60 weight %, desirably 20-50 weight % in a thermally sensitive color-developing layer, 20-80 weight %, desirably 30-70 weight % in an undercoating layer, 10-80 weight %, desirably 20-70 weight % in a protecting layer.

As an electron-donating leuco dye used in the present invention, any kind of dye which is public known in the fields of a pressure sensitive or thermally sensitive recording medium can be used and is not restricted and, for example, triphenylmethane compounds, fluorane compounds, fluorene or divinyl compounds are desirably used. Examples of specific colorless or pale colored dye (dye precursor) are shown as follows. These dye precursors can be used alone or in combination.

<Triphenyl Methane Leuco Dye>

3,3'-bis(p-dimethylaminophenyl)-6-dimethylaminophthalide (Crystal Violet Lactone), 3,3-bis(p-dimethylaminophenyl)phthalide (Malachite Green Lactone)

<Fluorane Leuco Dyes>

3-diethylamino-6-methylfluorane
3-diethylamino-6-methyl-7-anilinofluorane
3-diethylamino-6-methyl-7-(o,p-dimethylanilino)fluorane
3-diethylamino-6-methyl-7-chlorofluorane
3-diethylamino-6-methyl-7-(m-trifluoromethylanilino)fluorane
3-diethylamino-6-methyl-7-(o-chloroanilino)fluorane
3-diethylamino-6-methyl-7-(p-chloroanilino)fluorane
3-diethylamino-6-methyl-7-(o-fluoroanilino)fluorane
3-diethylamino-6-methyl-7-(m-methylanilino)fluorane
3-diethylamino-6-methyl-7-n-octylanilinofluorane
3-diethylamino-6-methyl-7-n-octylaminofluorane
3-diethylamino-6-methyl-7-benzylaminofluorane
3-diethylamino-6-methyl-7-dibenzylamonofluorane
3-diethylamino-6-chloro-7-methylfluorane
3-diethylamino-6-chloro-7-anilinofluorane
3-diethylamino-6-chloro-7-p-methylanilinofluorane
3-diethylamino-6-ethoxyethyl-7-anilinofluorane
3-diethylamino-7-methylfluorane 3-diethylamino-7-chlorofluorane
3-diethylamino-7-(m-trifluoromethylanilino)fluorane
3-diethylamino-7-(o-chloroanilino)fluorane
3-diethylamino-7-(p-chloroanilino)fluorane
3-diethylamino-7-(o-fluoroanilino)fluorane
3-diethylamino-benzo[a]fluorane
3-diethylamino-benzo[c]fluorane
3-dibutylamino-6-methyl-fluorane
3-dibutylamino-6-methyl-7-anilinofluorane
3-dibutylamino-6-methyl-7-(o,p-dimethylanilino)fluorane
3-dibutylamino-6-methyl-7-(o-chloroanilino)fluorane
3-dibutylamino-6-methyl-7-(p-chloroanilino)fluorane
3-dibutylamino-6-methyl-7-(o-fluoroanilino)fluorane
3-dibutylamino-6-methyl-7-(m-trifluoromethylanilino)fluorane
3-dibutylamino-6-methyl-chlorofluorane
3-dibutylamino-6-ethoxyethyl-7-anilinofluorane
3-dibutylamino-6-chloro-7-anilinofluorane
3-dibutylamino-6-methyl-7-p-methylanilinofluorane
3-dibutylamino-7-(o-chloroanilino)fluorane
3-dibutylamino-7-(o-fluoroanilino)fluorane
3-di-n-pentylamino-6-methyl-7-anilinofluorane
3-di-n-pentylamino-6-methyl-7-(p-chloroanilino)fluorane
3-di-n-pentylamino-7-(m-trifluoromethylanilino)fluorane
3-di-n-pentylamino-6-chloro-7-anilinofluorane
3-di-n-pentylamino-7-(p-chloroanilino)fluorane
3-pyrrolidino-6-methyl-7-anilinofluorane
3-piperidino-6-methyl-7-anilinofluorane
3-(N-methyl-N-propylamino)-6-methyl-7-anilinofluorane
3-(N-methyl-N-cyclohexylamino)-6-methyl-7-anilinofluorane
3-(N-ethyl-N-cyclohexylamino)-6-methyl-7-anilinofluorane
3-(N-ethyl-N-xylamino)-6-methyl-7-(p-chloroanilino)fluorane
3-(N-ethyl-p-toluidino)-6-methyl-7-anilinofluorane
3-(N-ethyl-N-isoamylamino)-6-methyl-7-anilinofluorane
3-(N-ethyl-N-isoamylamino)-6-chloro-7-anilinofluorane
3-(N-ethyl-N-tetrahydrofurfurylamino)-6-methyl-7-anilinofluorane
3-(N-ethyl-N-isobutylamino)-6-methyl-7-anilinofluorane
3-(N-ethyl-N-ethoxypropylamino)-6-methyl-7-anilinofluorane
3-cyclohexylamino-6-chlorofluorane
2-(4-oxahexyl)-3-dimethylamino-6-methyl-7-anilinofluorane
2-(4-oxahexyl)-3-diethylamino-6-methyl-7-anilinofluorane
2-(4-oxahexyl)-3-dipropylamino-6-methyl-7-anilinofluorane
2-methyl-6-p-(p-dimethylaminophenyl)aminoanilinofluorane
2-methoxy-6-p-(p-dimethylaminophenyl)aminoanilinofluorane
2-chloro-3-methyl-6-p-(p-phenylaminophenyl)aminoanilino-fluorane
2-chloro-6-p-(p-dimethylaminophenyl)aminoanilinofluorane
2-nitro-6-p-(p-diethylaminophenyl)aminoanilinofluorane
2-amino-6-p-(p-diethylaminophenyl)aminoanilinofluorane
2-diethylamino-6-p-(p-diethylaminophenyl)aminoanilinofluorane
2-phenyl-6-methyl-6-p-(p-phenylaminophenyl)aminoanilino-fluorane
2-benzyl-6-p-(p-phenylaminophenyl)aminoanilinofluorane
2-hydroxy-6-p-(p-phenylaminophenyl)aminoanilinofluorane
3-methyl-6-p-(p-dimethylaminophenyl)aminoanilinofluorane
3-diethylamino-6-p-(p-diethylaminophenyl)aminoanilinofluorane
3-diethylamino-6-p-(p-dibutylaminophenyl)aminoanilinofluorane
2,4-dimethyl-6-[(4-dimethylamino)anilino]-fluorane <Fluorene Leuco Dyes>
3,6,6-tris(dimethylamino)spiro[fluorene-9,3-phthalide]
3,6,6-tris(diethylamino)spiro[fluorene-9,3-phthalide]

<Divinyl Leuco Dyes>
3,3-bis-[2-(p-dimethylaminophenyl)-2-(p-methoxyphenyl) ethenyl]-4,5,6,7-tetrabromo phthalide
3,3-bis-[2-(p-dimethylaminophenyl)-2-(p-methoxyphenyl) ethenyl]-4,5,6,7-tetrachloro phthalide
3,3-bis-[1,1-bis(4-pyrrolidinophenyl)ethylene-2-yl]-4,5,6,7-tetrabromophthalide
3,3-bis-[1-(4-methoxyphenyl)-1-(4-pyrrolidinophenyl)ethylene-2-yl]-4,5,6,7-tetra chlorophthalide <Others>
3-(4-diethylamino-2-ethoxyphenyl)-3-(1-ethyl-2-methylindol-3-yl)-4-azaphthalide
3-(4-diethylamino-2-ethoxyphenyl)-3-(1-octyl-2-methylindol-3-yl)-4-azaphthalide
3-(4-cyclohexylethylamino-2-methoxyphenyl)-3-(1-ethyl-2-methylindol-3-yl)-4-azaphthalide
3,3-bis(1-ethyl-2-methylindol-3-yl)phthalide
3,6-bis(diethylamino)fluorane-y-(3'-nitro)anilinolactam
3,6-bis(diethylamino)fluorane-y-(4'-nitro)anilinolactam
1,1-bis-[2',2',2",2"-tetrakis-(p-dimethylaminophenyl)-ethenyl]-2,2-dinitrilethane
1,1-bis-[2',2',2",2"-tetrakis-(p-dimethylaminophenyl)-ethenyl]-2-β-naphthoyl ethane
1,1-bis-[2',2',2",2"-tetrakis-(p-dimethylaminophenyl)-ethenyl]-2,2-diacetylethane
bis-[2,2,2',2'-tetrakis-(p-dimethylaminophenyl)-ethenyl]-methylmalonic acid dimethyl ester.

In the present invention, conventional publicly known color-developing agents can be used in a range not obstructing the desired effect of the previously mentioned object. As an example of the color-developing agent, activated clay, attapulgite, bisphenol A, 4-hydroxybenzoates, 4-hydroxydiphthalates, phthalic acid monoesters, bis-(hydroxyphenyl) sulfides, 4-hydroxyphenyl-arylsulfones, 4-hydroxyphenylarylsulfonates, 1,3-di[2-(hydroxyphenyl)-2-propyl]-benzenes, 4-hydroxybenzoyl-oxybenzoate, bisphenolsulfones, aminobenzenesulfonamide compounds disclosed in JP H8-59603 A publication, diphenylsulfone crosslinked compounds disclosed in WO97/16420 International Publication, phenolic compounds disclosed in WO02/081229 International Publication or JP2002-301873 A publication, phenylnovolac condensation compounds disclosed in WO02/0987674 International Publication or WO03/029017 International Publication, urea-urethane compounds disclosed in WO00/14058 International Publication or JP2000-143611 A publication or thiourea compounds such as N,N'-di-m-chlorophenylthiourea can be mentioned. These compounds can be used alone or in combination. Among these compounds, 4,4'-dihydroxy diphenylsulfone (bisphenol S) and 4-hydroxy-4'-isopropoxydiphenylsulfone are most desirable from the view point of developed color tone and preservability.

Further, in the present invention, a conventional well-known sensitizer can be used. As the specific example of the sensitizer, saturated fatty acid mono amides, ethylenebisfattyacid amides, montan waxes, polyethylene waxes, 1,2-di(3-methylphenoxy)ethane, p-benzylbiphenyl, 4-biphenyl-p-tolylether, m-terphenyl, 1,2-diphenoxyethane, 4,4'-ethylenedioxy-bis-dibenzyl benzoate, dibenzoiloxymethane, 1,2-diphenoxyethane, bis[2-(4-methoxy-phenoxy)ethyl] ether, p-methylnitrobenzoate, benzyl p-benzyloxybenzoate, di-p-tolylcabonate, phenyl-α-naphthylcarbonate, 1,4-diethoxynaphthalene, 1-hydroxy-2-naphthoate, 4-(m-methylphenoxymethyl)diphenyl, dimethylphthalate, naphthylbenzylether, di-(p-methylbenzyl)oxalate, di-(p-chlorobenzyl)oxalate and 4-acethylbiphenyl can be mentioned, however, it is not intended to be limited to these compounds.

As a binder to be used in the present invention, for example, completely saponified polyvinyl alcohol having a degree of polymerization of 200 to 1,900, partially saponified polyvinyl alcohol, carboxy-denatured polyvinyl alcohol, amide-denatured polyvinyl alcohol, sulfonic acid-denatured polyvinyl alcohol, butyral-denatured polyvinyl alcohol, other denatured polyvinyl alcohol, hydroxyethylcellulose, methylcellulose, carboxymethylcellulose, styrene-maleic anhydride copolymer, styrene-butadiene copolymer, a cellulose derivative such as ethylcellulose or acetylcellulose, polyvinyl chloride, polyvinyl acetate, polyacrylamide, polyacrylate, polyvinyl butyral, polystyrol and a copolymer thereof, polyamide resin, silicon resin, petroleum resin, terpene resin, ketone resin and cumarone resin can be mentioned. Those high molecular weight substances can be used by dissolving in a solvent such as water, alcohol, ketones, esters or hydrocarbons, or emulsifying or dispersing as a paste in water or another medium, and can be used according to the desired quality.

Further, in the present invention, as an image stabilizer, which displays an oil resistance effect, in the range not obstructing the desired effect to the previously mentioned object, 4,4'-butylidene (6-t-butyl-3-methylphenol), 2,2'-di-t-butyl-5,5'-dimethyl-4,4'-sulphonyldiphenol, 1,1,3-tris(2-methyl-4-hydroxy-5-cyclohexylphenyl)butane or 1,1,3-tris(2-methyl-4-hydroxy-5-t-butylphenyl)butane or others can be added.

In the present invention, organic or inorganic fillers such as different kinds of silica, calcium carbonate, kaolin, calcined kaoline, diatomaceous earth, talc, titanium oxide or aluminum can be used together within the range not obstructing the effect, besides the above-mentioned hydrated silicate, of the present invention.

Further, it is possible to use a slipping agent such as waxes, U.V. ray-absorbing agent such as benzophenones or triazols, water-resistance agent such as glyoxal, dispersing agent, defoaming agent, anti-oxidant agent or fluorescent dye can be used.

The kinds and amounts of color-developing agent, dye and other components which are used in the thermally sensitive recording medium of the present invention, are decided according to the required properties and recording aptitude and not restricted, however, in general, 0.1 to 2 parts of basic colorless dye and 0.5 to 4 parts of filler are used to 1 part of color-developing agent, and the desirable amount of binder is 5-25% in total solid amount.

By applying a coating liquid of the above-mentioned composition on a substrate such as paper, recycled paper, synthetic paper, film, plastic film, plastic foam film or non-woven cloth, a desired thermally sensitive recording sheet can be obtained. Further, a complex sheet prepared by combining these sheets can be also used as a substrate.

The above-mentioned organic color-developing agent, basic colorless dye and additives to be added according to necessity are ground by a grinding machine such as a ball mill, attriter or sand grinder or adequate emulsifying machine so that the particle size becomes several micron or less. Further, a binder and various additives are added according to the object, and a coating liquid is prepared. The method for coating is not restricted and conventional well-known techniques can be used, for example, an off machine coater with various coaters such as an air knife coater, rod blade coater, bill blade coater, roll coater or curtain coater or an on machine coater can be voluntarily chosen and used.

EXAMPLE

The present invention will be illustrated more actually according to the Examples. In the illustration, the term parts are weight parts.

Preparation Example 1

(1) First process (neutralization ratio; 40%); $3^{rd}$ grade sodium silicate on the market ($SiO_2$: 20.0 weight %, $Na_2O$: 9.5 weight %) is diluted by water in a reaction vessel (200 liters volume), and 200 liters of a diluted sodium silicate solution of 6.7 weight % as $SiO_2$ is prepared. This sodium silicate solution is heated to 85° C., then aluminum sulfate (8 weight % concentration as $Al_2O_3$; hereinafter shortened to band) of an amount corresponding to 10 weight % of a neutralizing equivalent is added by 200 g/min dropping speed under a strong stirring condition so as not to grow a coarse gel. Then, sulfuric acid (concentration; 98 weight %) of an amount corresponding to 30 weight % of a neutralizing equivalent. After being added, the obtained partially neutralized solution is matured under continuous stirring and simultaneously treated by cyclic grinding (aiming at a 7 μm particle size) by a vertical sand grinder (volume 2 gallons, the filling ratio of 1 mm diameter glass beads is 70 weight %). These maturing and grinding treatments are carried out for 3 hours.

(2) Second process (neutralization ratio; 40%); Then, the temperature of the slurry is elevated to 90° C. and sulfuric acid of the same concentration as the first process is added under the same condition as the first process to 80 weight % of a neutralizing equivalent and is matured under continuous stirring for 32 minutes.

(3) Third process (neutralization ratio; 20%); After that, sulfuric acid of the same concentration is added to the matured slurry at a 76 g/min dropping speed and the pH of the slurry is adjusted to 6.

(4) Evaluation; Slurry after the third process is filtered, washed by water and re-pulped into DI water, then hydrated silicic acid slurry is recovered. The average particle size of the obtained slurry is measured. Further, the slurry is filtered and dissolved in ethanol so that the solids part is 10 weight %, filtered again, dried at 105° C. and the oil-absorption amount measured. The average particle size of the obtained particles was 6.1 μm and the oil-absorption amount was 230 ml/100 g. Other features are shown in Table 1.

Preparation Example 2

By the same method as Preparation Example 1, except for changing the addition amount of aluminum sulfate in the first process to 20 weight %, hydrated silicate is prepared. The features of the obtained hydrated silicate are shown in Table 1.

Preparation Example 3

By same method as Preparation Example 1, except for changing the addition amount of aluminum sulfate in the first process to 40 weight % (total amount), hydrated silicate is prepared. The features of the obtained hydrated silicate are shown in Table 1.

Preparation Example 4

By the same method as Preparation Example 1, except for changing the addition amount of aluminum sulfate in the first process to 40 weight % (total amount) and changing the addition amount of aluminum sulfate in the second process to 20% of the neutralization equivalent, hydrated silicate is prepared. The features of the obtained hydrated silicate are shown in Table 1.

Preparation Example 5-6

The hydrated silicate obtained in Preparation Example 2 is ground in a wet condition and two kinds of hydrated silicate, whose particle size are different, are prepared. The features of the obtained hydrated silicate are shown in Table 1.

Preparation Example 7-8

By the same method as Preparation Example 1, except for not using band in the first, second and third processes, using sulfuric acid for all 100 weight % of the neutralization equivalent and changing the grinding conditions in the first process, two kinds of hydrated silicate are prepared. The features of the obtained hydrated silicate are shown in Table 1.

Preparation Example 9-10

The hydrated silicate obtained in Preparation Example 8 is ground in a wet condition and two kinds of hydrated silicate whose particle size are different are prepared. The features of the obtained hydrated silicate are shown in Table 1.

Preparation Example 11

The hydrated silicate obtained in Preparation Example 2 is dried and then ground in a ball mill and two kinds of hydrated silicate whose particle size are different are prepared. The features of the obtained hydrated silicate are shown in Table 1.

Preparation Example 12

The hydrated silicate obtained in Preparation Example 7 is dried and then ground in a ball mill and two kinds of hydrated silicate whose particle size are different are prepared. The features of the obtained hydrated silicate are shown in Table 1.

The oil-absorption amount, particle size distribution and content of metallic compound (aluminum) of the hydrated silicate obtained by preparation Examples 1-12 are measured as follows.

Oil-absorption amount: measured by the method prescribed in JIS-K-5101

Particle size distribution laser diffraction/scattering method): a specimen of slurry of hydrated silicate is dropped and mixed in DI water to which 0.2 weight % of sodium hexametaphosphate, which is a dispersing agent, is added and a uniform dispersion is obtained, and measured by a laser type particle size measuring machine (used instrument: Mastersizer S type, product of Malvern).

Content of aluminum: measured by a fluorescent X-ray analyzer (used instrument: Oxford ED 2000 type).

TABLE 1

| hydrated silicate Prep. Example | amount of aluminium sulfate | ave. particle size μm | oil absorption amount ml/100 g | content of $Al_2O_3$ % | particle size distribution D10/D90 | particle size distribution D20/D80 | remarks |
|---|---|---|---|---|---|---|---|
| 1 | 10% | 6.1 | 230 | 1.1 | 8.5 | 4.2 | |
| 2 | 20% | 5.1 | 257 | 2.5 | 7.3 | 3.5 | |
| 3 | 40% | 5.5 | 214 | 5.0 | 7.9 | 4.4 | |
| 4 | 60% | 4.6 | 201 | 6.6 | 8.7 | 3.8 | |
| 5 | 20% | 2.3 | 155 | 2.5 | 6.1 | 3.9 | *1 |
| 6 | 20% | 1.4 | 119 | 2.5 | 4.8 | 2.6 | |
| 7 | 0% | 5.4 | 313 | 0.0 | 8.9 | 4.5 | |
| 8 | 0% | 4.1 | 301 | 0.0 | 8.1 | 4.1 | |
| 9 | 0% | 3.3 | 235 | 0.0 | 7.8 | 3.8 | *2 |
| 10 | 0% | 2.2 | 177 | 0.0 | 6.3 | 3.6 | |
| 11 | 20% | 2.5 | 151 | 2.5 | 14.3 | 10.6 | *3 |
| 12 | 0% | 2.7 | 156 | 0.0 | 13.2 | 10.8 | *4 |
| silica on | — | 3.7 | 240 | 0.7 | 15.4 | 10.3 | X37B |
| the | — | 1.7 | 110 | 0.0 | 16.2 | 11.5 | P604 |
| market | — | 3.3 | 250 | 0.0 | 13.3 | 9.8 | P78A |

Particle size distribution
D10/D90: difference between D10 and D90 (μm)
D20/D80: difference between D20 and D80 (μm)
*1: grinding of Preparation Example 2
*2: grinding of Preparation Example 8
*3: dry grinding of Preparation Example 2
*4: dry grinding of Preparation Example 7

EXAMPLES•COMPARATIVE EXAMPLES

Example 1

Coating Liquid for Undercoat Layer

| | |
|---|---|
| hydrated silicate of preparation Example 2 (solid part 20%) | 250.0 parts |
| 10% aqueous solution of 10% polyvinyl alcohol | 50.0 parts |

A coating liquid for an underlayer of above blending ratio is prepared.

<Coating Liquid for Thermally Sensitive Layer>

Regarding each material for the dye and color-developing agent, dispersions of the following blending ratio are previously prepared and are separately ground in wet condition by a sand grinder so that the average particle size is 0.5 μm.

<Dispersion of Color-Developing Agent>

| | |
|---|---|
| 4-hydroxy-4'-isopropoxydiphenylsulfone | 6.0 parts |
| 10% aqueous solution of polyvinyl alcohol | 18.8 parts |
| water | 11.2 parts |

<Dispersion or Dye>

| | |
|---|---|
| 3-di-n-butylamino-6-methyl-7-anilinofluorane (ODB-2) | 3.0 parts |
| 10% aqueous solution of polyvinyl alcohol | 6.9 parts |
| water | 3.9 parts |

<Dispersion of Sensitizer>

| | |
|---|---|
| diphenylsulfone | 6.0 parts |
| 10% aqueous solution of polyvinyl alcohol | 18.8 parts |
| water | 11.2 parts |

The compositions mentioned below are mixed and the coating liquid for thermally sensitive color-developing layer is obtained.

| | |
|---|---|
| dispersion of color-developing agent | 36.0 parts |
| dispersion of dye (ODB-2) | 13.8 parts |
| dispersion of sensitizer | 36.0 parts |
| 30% dispersion of kaolin (CAPIM CC, product of RIO CAPIM) | 43.0 parts |
| 30% dispersion of zinc stearate | 6.7 parts |

<Thermally Sensitive Recording Medium>

The above-mentioned coating liquid for an undercoat layer is coated on the surface of a paper whose grammage is 50 g/m$^2$ and dried so that the dry weight is 6.0 g/m$^2$ and treated by a super calendar so that the Beck smoothness is 600-800 seconds. Then, a thermally sensitive recording medium is obtained.

Example 2

Coating Liquid for Under Layer

| | |
|---|---|
| 30% dispersion of kaolin (CAPIM CC, product of RIO CAPIM) | 167.0 parts |
| 10% aqueous solution of polyvinyl alcohol | 50.0 parts |

A coating liquid for an underlayer of the above blending ratio is prepared.

<Coating Liquid for Thermally Sensitive Layer>

By the same process as Example 1, except for changing the kaolin dispersion to 65 parts of hydrated silicate (solid part 20%) of Preparation Example 2, a coating liquid for a thermally sensitive layer is obtained.

<Thermally Sensitive Recording Medium>

A thermally sensitive recording medium is obtained by the same process as Example 1 using the above-mentioned coating liquid for the underlayer and thermally sensitive layer.

Example 3

By the same process as Example 1, except for changing the hydrated silicate of Preparation Example 2 to the hydrated silicate of Preparation Example 5 (solid part 20%), a thermally sensitive recording medium is prepared.

Example 4

By the same process as Example 2, except for changing the hydrated silicate of Preparation Example 2 to the hydrated silicate of Preparation Example 5 (solid part 20%), a thermally sensitive recording medium is prepared.

Example 5

By the same process as Example 1, except for changing the kaolin dispersion to the hydrated silicate of Preparation Example 5 (solids part 20%), a thermally sensitive recording medium is prepared.

Example 6

By the same process as Example 1, except for changing the hydrated silicate of Preparation Example 2 to the hydrated silicate of Preparation Example 1 (solids part 20%), a thermally sensitive recording medium is prepared.

Example 7

By the same process as Example 1, except for changing the hydrated silicate of Preparation Example 2 to the hydrated silicate of Preparation Example 3 (solids part 20%), a thermally sensitive recording medium is prepared.

Example 8

By the same process as Example 1, except for changing the hydrated silicate of Preparation Example 2 to the hydrated silicate of Preparation Example 4 (solids part 20%), a thermally sensitive recording medium is prepared.

Example 9

By the same process as Example 2, except for changing the hydrated silicate of Preparation Example 2 to the hydrated silicate of Preparation Example 1 (solids part 20%), a thermally sensitive recording medium is prepared.

Example 10

By the same process as Example 2, except for changing the hydrated silicate of Preparation Example 2 to the hydrated silicate of Preparation Example 3 (solids part 20%), a thermally sensitive recording medium is prepared.

Example 11

By the same process as Example 2, except for changing the hydrated silicate of Preparation Example 2 to the hydrated silicate of Preparation Example 4 (solids part 20%), a thermally sensitive recording medium is prepared.

Example 12

By the same process as Example 1, except for changing the hydrated silicate of Preparation Example 2 to the hydrated silicate of Preparation Example 9 (solids part 20%), a thermally sensitive recording medium is prepared.

Example 13

By the same process as Example 2, except for changing the hydrated silicate of Preparation Example 2 to the hydrated silicate of Preparation Example 9 (solid part 20%), a thermally sensitive recording medium is prepared.

Comparative Example 1

By the same process as Example 1, except for changing the hydrated silicate of Preparation Example 2 to the hydrated silicate of Preparation Example 11 (solids part 20%), a thermally sensitive recording medium is prepared.

Comparative Example 2

By the same process as Example 1, except for changing the hydrated silicate of Preparation Example 2 to the hydrated silicate of Preparation Example 12 (solids part 20%), a thermally sensitive recording medium is prepared.

Comparative Example 3

By the same process as Example 2, except for changing the hydrated silicate of Preparation Example 2 to the hydrated silicate of Preparation Example 11 (solids part 20%), a thermally sensitive recording medium is prepared.

Comparative Example 4

By the same process as Example 2, except for changing the hydrated silicate of Preparation Example 2 to the hydrated silicate of Preparation Example 12 (solids part 20%), a thermally sensitive recording medium is prepared.

Comparative Example 5

By the same process as Example 5, except for changing the hydrated silicate of Preparation Example 5 to the hydrated silicate of Preparation Example 11 (solids part 20%), a thermally sensitive recording medium is prepared.

Comparative Example 6

By the same process as Example 1, except for changing the hydrated silicate of Preparation Example 2 to silica on the market, a thermally sensitive recording medium is prepared.

Reference Examples 1-3

By the same process as Example 1, except for changing the hydrated silicate of Preparation Example 2 to silica on the market <X37B (product of Tokuyama), P604(product of Mizusawa Kagaku), P78A (product of Mizusawa Kagaku): solids part 20%>, a thermally sensitive recording media are prepared.

Reference Examples 4-6

By the same process as Example 2, except for changing the hydrated silicate of Preparation Example 2 to silica on the market <X37B (product of Tokuyama), P604(product of Mizusawa Kagaku), P78A (product of Mizusawa Kagaku): solids part 20%>, a thermally sensitive recording media was prepared.

The evaluation tests of the following evaluation items are carried out on specimens obtained by the above-mentioned Examples, Comparative Examples and Reference Examples. The results are shown in Table 2.

(Color-Developing Sensitivity)

A printing test is carried out on the prepared thermally sensitive recording medium at an applied energy of 0.34 mJ/dot by using TH-PMD, which is a product of Okura Denki. Density of the printed image is measured by a Macbeth Densitometer (using an amber filter).

(Head Debris)

A printing test is carried out by using Label Printer L'esprit T8, which is a product of Sato, and the adhesion of head debris is evaluated by an inspector's eye.

○: head debris is not observed

Δ: head debris is observed slightly, come off of printing is not observed

X: many head debris are observed, come off of printing is observed (Stick)

A printing test is carried out by using Canon Handy Terminal HT180 at 0° C. and the presence of stick is confirmed.

○: white come-off at full printed part is not observed

Δ: white come-off at full printed part is slightly observed

X: many white come-offs at full printed part head debris are observed (Brightness)

JIS P8123

(Printing Aptitude (Surface Strength))

The presence of surface picks is measured by an inspector's eye when printing ink (Tack 9) is printed on the surface of a thermally sensitive recording medium by 100 m/min using a Prufbau printer and evaluated according to the following standard.

○: surface picks are not observed

Δ: surface picks are slightly observed

X: many surface picks are observed (Abrasion of Head)

The abrasion of a head by the prepared thermally sensitive recording media is measured by a thermal printer LTP-411, which is a product of Seiko Electric Industries. A 720,000 lines printing test is carried out under the following conditions;

applying electric voltage: 5.1V, method for printing: go and back printing, printing pattern: black part 50% printing, evaluation standard is as follows.

○: good printing is available without causing head worn out

X: worn-out head is caused and come off of printing is observed

TABLE 2

| | | undercoat layer | thermally sensitive recording layer | color developing sensitivity | printing aptitude (coating layer strength) | debris adhering resistance | sticking resistance | head abrasion resistance | brightness % |
|---|---|---|---|---|---|---|---|---|---|
| Example | 1 | Prep. Ex. 2 | kaolin | 1.43 | ○ | ○ | ○ | — | 89 |
| | 2 | kaolin | Prep. Ex. 2 | 1.50 | ○ | ○ | ○ | ○ | 89 |
| | 3 | Prep. Ex. 5 | kaolin | 1.49 | ○ | ○ | ○ | — | 89 |
| | 4 | kaolin | Prep. Ex. 5 | 1.50 | ○ | ○ | ○ | ○ | 90 |
| | 5 | Prep. Ex. 2 | Prep. Ex. 5 | 1.52 | ○-Δ | ◎ | ◎ | ○ | 90 |
| | 6 | Prep. Ex. 1 | kaolin | 1.44 | ○ | ○-Δ | ○-Δ | — | 89 |
| | 7 | Prep. Ex. 3 | kaolin | 1.45 | ○ | ○ | ○ | — | 89 |
| | 8 | Prep. Ex. 4 | kaolin | 1.43 | ○ | Δ | Δ | — | 89 |
| | 9 | kaolin | Prep. Ex. 1 | 1.47 | ○ | ○ | ○ | ○ | 89 |
| | 10 | kaolin | Prep. Ex. 3 | 1.48 | ○ | ○ | ○ | ○ | 89 |
| | 11 | kaolin | Prep. Ex. 4 | 1.46 | ○ | Δ | Δ | ○ | 89 |
| | 12 | Prep. Ex. 9 | kaolin | 1.42 | ○ | x | x | — | 86 |
| | 13 | kaolin | Prep. Ex. 9 | 1.37 | ○ | x | x | ○ | 86 |
| Comparative Example | 1 | Prep. Ex. 11 | kaolin | 1.40 | x | ○ | ○ | — | 84 |
| | 2 | Prep. Ex. 12 | kaolin | 1.43 | x | ○ | ○ | — | 85 |
| | 3 | kaolin | Prep. Ex. 11 | 1.43 | x | ○ | ○ | x | 89 |
| | 4 | kaolin | Prep. Ex. 12 | 1.45 | x | ○ | ○ | x | 85 |
| | 5 | Prep. Ex. 11 | Prep. Ex. 11 | 1.43 | x | ◎ | ◎ | x | 90 |
| | 6 | kaolin | Kaolin | 1.29 | ○ | x | x | ○ | 83 |
| Reference Example | 1 | X37B | Kaolin | 1.45 | x | — | — | — | 85 |
| | 2 | P604 | Kaolin | 1.49 | x | — | — | — | 86 |
| | 3 | P78A | Kaolin | 1.47 | x | — | — | — | 85 |
| | 4 | kaolin | X37B | 1.48 | x | — | — | x | 86 |
| | 5 | kaolin | P604 | 1.46 | x | — | — | x | 87 |
| | 6 | kaolin | P78A | 1.47 | x | — | — | x | 87 |

INDUSTRIAL APPLICABILITY

By the present invention, a thermally sensitive recording medium having excellent color-developing sensitivity and strong coating layer strength can be obtained by a thermally sensitive recording medium comprising a single layer or multi-layers, wherein, at least one layer on a substrate is a thermally sensitive recording layer that contains a colorless or pale colored electron-donating leuco dye and an electron-accepting color-developing agent. Further, at least one layer on the substrate contains a hydrated silicic acid compound which is treated by a wet grinding treatment in a deposition process of the hydrated silicic acid compound. Especially, when the hydrated silicic acid compound is hydrated silicate, a thermally sensitive recording medium of a high brightness, which is superior in color-developing sensitivity and coating layer strength and, further, has excellent head abrasion resistance, debris adhering resistance and sticking resistance can be obtained. Further, by containing the hydrated silicic acid compound in a layer which contacts with a thermal head, the head abrasion resistance is improved.

The invention claimed is:

1. A thermally sensitive recording medium comprising at least one layer comprising a thermally sensitive recording layer provided on a substrate, the thermally sensitive recording layer containing a colorless or pale colored electron-donating leuco dye and an electron-accepting color-developing agent and at least one layer provided on the substrate containing a hydrated silicic acid compound which is treated by wet grinding treatment in a deposition process of the hydrated silicic acid compound and is obtained by neutralizing an aqueous solution of sodium silicate with a mineral acid and an aqueous solution of an acid metallic salt.

2. The thermally sensitive recording medium of claim 1, wherein the content of metallic compound in the hydrated silicate to $SiO_2$ weight % by converted value to oxide is 1.0-8.0 weight %.

3. The thermally sensitive recording medium of claim 1, wherein the difference in particle size, D10/D90, between a particle size which contains a 10% integrated volume from the minimum size D10 and contains a 90% integrated volume from the minimum size D90 is 9 μm or less and the difference in particle size, D20/D80 between a particle size which contains a 20% integrated volume from the minimum size D20 and contains a 80% integrated volume from the minimum size D80 is 5 μm or less.

4. The thermally sensitive recording medium according to claim 3, wherein D10/D90 is 7 μm or less and D20/D80 is 4 μm or less.

5. The thermally sensitive recording medium according to claim 1, wherein an average particle size of the hydrated silicic acid compound is 1-15 μm, as measured by a laser ray method, and an oil-absorption amount is 100-350 ml/100 g.

6. The thermally sensitive recording medium according to claim 1, wherein the metallic compound is aluminum oxide.

* * * * *